US011361712B2

(12) United States Patent
Xu et al.

(10) Patent No.: US 11,361,712 B2
(45) Date of Patent: Jun. 14, 2022

(54) PIXEL CIRCUIT, DRIVING METHOD THEREOF, AND DISPLAY DEVICE

(71) Applicant: BOE TECHNOLOGY GROUP CO., LTD., Beijing (CN)

(72) Inventors: Pan Xu, Beijing (CN); Yicheng Lin, Beijing (CN); Guoying Wang, Beijing (CN); Ling Wang, Beijing (CN)

(73) Assignee: BOE Technology Co., LTD., Beijing (CN)

( * ) Notice: Subject to any disclaimer, the term of this patent is extended or adjusted under 35 U.S.C. 154(b) by 57 days.

(21) Appl. No.: 16/959,011

(22) PCT Filed: Dec. 12, 2019

(86) PCT No.: PCT/CN2019/124759

§ 371 (c)(1),
(2) Date: Jun. 29, 2020

(87) PCT Pub. No.: WO2020/140717

PCT Pub. Date: Jul. 9, 2020

(65) Prior Publication Data

US 2021/0217362 A1 Jul. 15, 2021

(30) Foreign Application Priority Data

Jan. 2, 2019 (CN) ..... 201910002345.3

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0426* (2013.01);
(Continued)

(58) Field of Classification Search
CPC ..... G09G 3/3233; G09G 3/3275; G09G 2300/0426; G09G 2300/0842;
(Continued)

(56) References Cited

U.S. PATENT DOCUMENTS 9,230,481 B2 1/2016 Tseng et al.
2006/0244688 A1* 11/2006 Ahn ..... G09G 3/3233 345/76

(Continued)

FOREIGN PATENT DOCUMENTS

CN 1591104 A 3/2005
CN 105957473 A 9/2016

(Continued)

OTHER PUBLICATIONS

International search report of PCT application No. PCT/CN2019/124759 dated Mar. 16, 2020.

(Continued)

*Primary Examiner* — Roberto W Flores
(74) *Attorney, Agent, or Firm* — Fay Sharpe LLP

(57) ABSTRACT

The present disclosure discloses a pixel circuit, a driving method thereof, a display panel, and a display device, which belong to the technical field of display. The pixel circuit includes a data writing sub-circuit, a compensation sub-circuit, a storage sub-circuit, and a driving sub-circuit. Since the compensation sub-circuit may output a first power signal to a first node, the storage sub-circuit may adjust the potential of a second node according to the potential of the first node.

19 Claims, 7 Drawing Sheets

(52) U.S. Cl.
CPC ..... *G09G 2300/0842* (2013.01); *G09G 2320/0233* (2013.01); *G09G 2330/02* (2013.01)

(58) Field of Classification Search
CPC ..... G09G 2320/0233; G09G 2330/02; G09G 2310/08; G09G 2320/0295; G09G 2320/045
See application file for complete search history.

(56) References Cited

U.S. PATENT DOCUMENTS

| | | | | |
|---|---|---|---|---|
| 2008/0246785 | A1* | 10/2008 | Shirasaki | G09G 3/3233 345/212 |
| 2011/0018855 | A1 | 1/2011 | Miyazawa | |
| 2011/0090208 | A1* | 4/2011 | Long | G09G 3/3233 345/82 |
| 2012/0327064 | A1* | 12/2012 | Qi | G09G 3/3233 345/82 |
| 2015/0053953 | A1* | 2/2015 | Ebisuno | H01L 27/3279 257/40 |
| 2015/0170569 | A1* | 6/2015 | Han | G09G 3/3266 345/78 |
| 2015/0187273 | A1* | 7/2015 | Chang | G09G 3/3233 345/690 |
| 2015/0187276 | A1* | 7/2015 | Shim | G09G 3/3291 345/77 |
| 2016/0253963 | A1* | 9/2016 | Yang | G09G 3/3225 345/211 |
| 2016/0284280 | A1* | 9/2016 | Mu | G09G 3/3258 |
| 2017/0221420 | A1 | 8/2017 | Zhu | |
| 2017/0294163 | A1* | 10/2017 | Wu | G09G 3/3233 |
| 2018/0190198 | A1 | 7/2018 | Kim | |
| 2018/0254009 | A1 | 9/2018 | Li et al. | |
| 2018/0301090 | A1 | 10/2018 | Kuang | |

FOREIGN PATENT DOCUMENTS

| | | | |
|---|---|---|---|
| CN | 106652911 | A | 5/2017 |
| CN | 106652912 | A | 5/2017 |
| CN | 106847187 | A | 6/2017 |
| CN | 107622754 | A | 1/2018 |
| CN | 107731171 | A | 2/2018 |
| CN | 108257561 | A | 7/2018 |
| CN | 109545145 | A | 3/2019 |

OTHER PUBLICATIONS

First office action of Chinese application No. 201910002345.3 dated Dec. 18, 2019.

* cited by examiner

PIXEL CIRCUIT, DRIVING METHOD THEREOF, AND DISPLAY DEVICE

The present disclosure is a 371 of PCT Application No. PCT/CN2019/124759, filed Dec. 12, 2019, which claims priority to Chinese Patent Application No. 201910002345.3, filed on Jan. 2, 2019 and entitled "PIXEL CIRCUIT, DRIVING METHOD THEREOF, AND DISPLAY DEVICE", the entire contents of which are incorporated herein by reference.

TECHNICAL FIELD

The present disclosure relates to the field of display technology, and more particularly to a pixel circuit and a driving method thereof, a display panel, and a display device.

BACKGROUND

Active matrix organic light-emitting diode (AMOLED), as a current-type light-emitting device, has the characteristics of self-luminescence, fast response, wide viewing angle, and that may be fabricated on a flexible substrate, so it is increasingly used in the field of high-performance display field.

In an AMOLED display device, each pixel unit includes an AMOLED and a pixel circuit, the pixel circuit may provide a driving current to the AMOLED to drive the AMOLED to emit light. The pixel circuit generally includes: a driving transistor, a switching transistor, and a capacitor. The switching transistor may output the data voltage provided by a data signal terminal to the driving transistor, and the driving transistor may convert the data voltage into a driving current for driving the AMOLED to emit light, wherein the magnitude of the driving current is related to the threshold voltage Vth of the driving transistor.

SUMMARY

The present disclosure provides a pixel circuit and a driving method thereof, a display panel, and a display device. The technical solutions are as follows:

In one aspect, a pixel circuit is provided. The pixel circuit includes: a data writing sub-circuit, a compensation sub-circuit, a storage sub-circuit and a driving sub-circuit, wherein the data writing sub-circuit is respectively connected to a first control signal terminal, a data signal terminal and a first node, and the data wilting sub-circuit is used to output a data signal from the data signal terminal to the first node in response to a first control signal provided by the first control signal terminal;

the compensation sub-circuit is respectively connected to a second control signal terminal, a first power terminal and the first node, and the compensation sub-circuit is used to output a first power signal from the first power terminal to the first node in response to a second control signal provided by the second control signal terminal;

the storage sub-circuit is respectively connected to the first node and a second node, and the storage sub-circuit is used to adjust the potential of the second node according to the potential of the first node; and the driving sub-circuit is respectively connected to the first node, the first power terminal and the second node, the second node is connected to the second node, and the driving sub-circuit is used to drive the light-emitting unit to emit light under a drive of the first node and the first power signal.

Optionally, the compensation sub-circuit includes: a first transistor;

the gate of the first transistor is connected to the second control signal terminal, a first electrode of the first transistor is connected to the first power terminal, and a second electrode of the first transistor is connected to the first node.

Optionally, the data writing sub-circuit includes: a second transistor;

the gate of the second transistor is connected to the first control signal terminal, a first electrode of the second transistor is connected to the data signal terminal, and a second electrode of the second transistor is connected to the first node.

Optionally, the driving sub-circuit includes a driving transistor;

the gate of the driving transistor is connected to the first node, a first electrode of the driving transistor is connected to the first power terminal, and a second electrode of the driving transistor is connected to the second node.

Optionally, the storage sub-circuit includes a capacitor;

one end of the capacitor is connected to the first node, and the other end of the capacitor is connected to the second node.

Optionally, the pixel circuit further includes a detecting sub-circuit;

the detecting sub-circuit is connected to a third control signal terminal, a detecting signal line and the second node, respectively, and the detecting sub-circuit is used to output a detecting signal from the detecting signal line to the second node and output a potential of the second node to the detecting signal line in response to a third control signal provided by the third control signal terminal, the detecting signal line being connected to an external compensation circuit of a display panel.

Optionally, the detecting sub-circuit includes a third transistor;

the gate of the third transistor is connected to the third control signal terminal, a first electrode of the third transistor is connected to the second node, and a second electrode of the third transistor is connected to the detecting signal line.

Optionally, the transistors comprised in the respective sub-circuits in the pixel circuit are N-type transistors.

In another aspect, a driving method for a pixel circuit is provided. The method is applied to the pixel circuit of the aforesaid aspect. The method includes:

in a first stage, when the potential of the first control signal provided by the first control signal terminal is a first potential, and the potential of the second control signal provided by the second control signal terminal and the potential of the data signal provided by the data signal terminal is a second potential, outputting the data signal by the data writing sub-circuit to the first node in response to the first control signal;

in a second stage, when the potential of the first control signal is the second potential, the potential of the second control signal is the first potential, and the potential of the first power signal provided by the first power terminal is the second potential, outputting the first power signal by the compensation sub-circuit to the first node in response to the second control signal, and adjusting the potential of the second node by the storage sub-circuit according to the potential of the first node;

in a third stage, when the potential of the first control signal is the first potential, the potential of the second control signal is the second potential, and the potential of the data signal is the first potential, outputting the data signal by the data writing sub-circuit to the first node in response to the first control signal, and adjusting the potential of the second node by the storage sub-circuit according to the potential of the first node; and in a fourth stage, when the potential of the first control signal is the second potential, and the potential of the first power signal is a first potential, driving the light-emitting unit to emit light by the driving sub-circuit in response to the potentials of the first power signal and the first node.

the pixel circuit further includes a detecting sub-circuit;

in the first stage, when the potential of the third control signal provided by the third control signal terminal is the first potential, and the potential of the detecting signal provided by the detecting signal line is the second potential, outputting the detecting signal to the second node by the detecting sub-circuit in response to the third control signal.

Optionally, the method further includes:

in a fifth stage, when the potential of the third control signal is the first potential, outputting the potential of the second node to the detecting signal line by the detecting sub-circuit in response to the third control signal, and outputting the potential of the second node by the detecting signal line to an external compensation circuit of the display panel.

Optionally, the fifth stage is running during the blanking stage of the display panel; after entering the blanking stage and before running the fifth stage, the method further includes:

running the first stage, the second stage, and the third stage sequentially.

Optionally, the first potential is higher than the second potential.

In another aspect, a display panel is provided. The display panel includes: a plurality of pixel units, each of which includes: the pixel circuit of the aforesaid aspect, and a light-emitting unit connected to the pixel circuit.

In yet another aspect, a display device is provided. The display device includes: a source driving circuit, and the display panel of the aforesaid aspect; wherein the source driving circuit is respectively connected to a data signal terminal connected with each pixel circuit in the display panel, and is used to provide a data signal to the data signal terminal.

Optionally, each of the pixel circuits further includes: a detecting sub-circuit, which is connected to a detecting signal line; and the display device further includes an external compensation circuit;

detecting signal lines connected to the detecting sub-circuit in each pixel circuit is connected to the external compensation circuit, and the detecting sub-circuit in each pixel circuit is used to output the potential of the second node in the pixel circuit to the external compensation circuit through the detecting signal lines; and the external compensation circuit is used to adjust the potential of the data signal input to the source driving circuit according to the potential of the second node.

Optionally, in the display panel, the detecting sub-circuits in the pixel units in the same column are connected to the same detecting signal line.

Optionally, the display device includes: a plurality of pixels, each of the pixels comprising a plurality of adjacent pixel units; the detecting sub-circuits in the plurality of adjacent pixel units are connected to the same detecting signal line.

DETAILED DESCRIPTION

For clearer descriptions of the objects, technical solutions and advantages in the present disclosure, the implementation of the present disclosure is described in detail below in combination with the accompanying drawings.

The transistors used in all the embodiments of the present disclosure may be field effect transistors or other devices with the same characteristics thereof. The transistors used in the embodiments of the present disclosure are mainly switching transistors according to their functions in the circuit. Since the source and drain of the switching transistor used here are symmetrical, the source and drain are interchangeable. In embodiments of the present disclosure, the source is referred to as a first electrode and the drain is referred to as a second electrode; or the drain may be referred to as a first electrode and the source may be referred to as a second electrode. According to the form in the figures, the middle terminal of a transistor is a gate, the signal input terminal thereof is a source, and the signal output terminal thereof is a drain. In addition, the switching transistors used in the embodiments of the present disclosure may include any one of a P-type switching transistor and an N-type switching transistor, wherein the P-type switching transistor is turned on when the gate is at a low level and turned off when the gate is at a high level, while the N-type switching transistor is turned on when the gate is at a high level and is turned off when the gate is at a low level. In addition, multiple signals in various embodiments of the present disclosure correspond to a first potential and a second potential, wherein the first potential and the second potential only represent that the potentials of the signal include two state quantities, and do not represent that the first potential or the second potential has a specific value.

Since the Vth of the driving transistor may be different for different pixel units, and the Vth of the driving transistor will drift with time, the driving current flowing through the AMOLED of each pixel unit will be different, which may cause that the uniformity of the display brightness of an AMOLED display device is low, and the display effect is poor. With the development of display technology, in order to ensure the uniformity of the display brightness of a display device and improve the display effect of the display device, it is necessary to compensate the Vth of the driving transistor.

Figure 1:
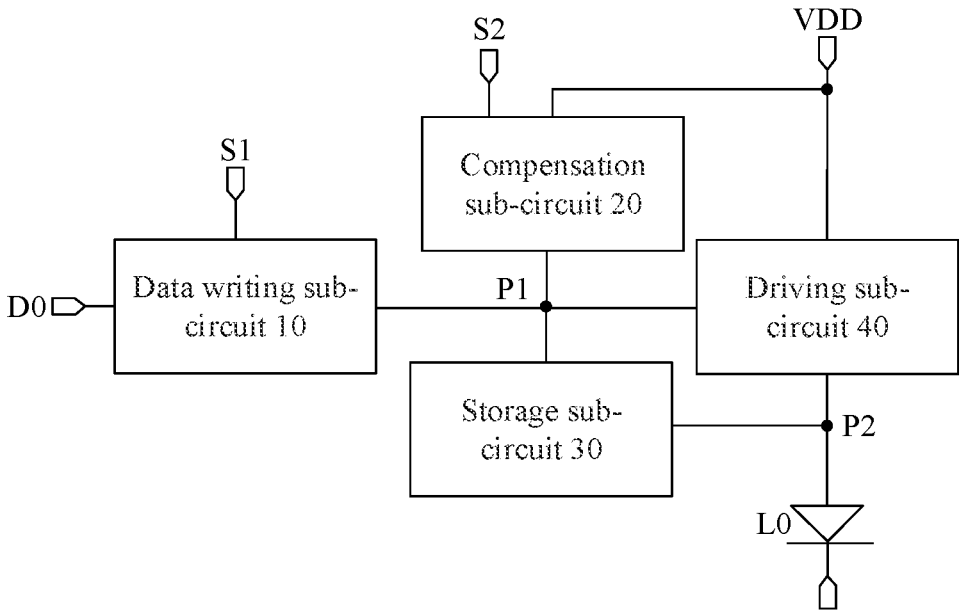
FIG. 1 is a schematic structural diagram of a pixel circuit provided by an embodiment of the present disclosure.

An embodiment of the present disclosure provides a pixel circuit as shown in FIG. 1, and the pixel circuit may include: a data writing sub-circuit 10, a compensation sub-circuit 20, a storage sub-circuit 30 and a driving sub-circuit 40.

The data writing sub-circuit 10 may be connected to a first control signal terminal S1, a data signal terminal D0, and a first node P1, respectively. The data writing sub-circuit 10 may output a data signal from the data signal terminal D0 to the first node P1 in response to a first control signal provided by the first control signal terminal S1.

Exemplarily, the data writing sub-circuit 10 may output the data signal from the data signal terminal D0 to the first node P1 when the potential of the first control signal is a first potential. In embodiments of the present disclosure, the first potential may be an effective potential.

The compensation sub-circuit 20 may be connected to a second control signal terminal S2, a first power terminal VDD, and the first node P1, respectively. The compensation sub-circuit 20 may output a first power signal from the first power terminal VDD to the first node P1 in response to the second control signal provided by the second control signal terminal S2.

Exemplarily, the compensation sub-circuit 20 may output the first power signal from the first power terminal VDD to the first node P1 when the potential of the second control signal is the first potential.

The storage sub-circuit 30 may be connected to the first node P1 and a second node P2, respectively. The storage sub-circuit 30 may adjust the potential of the second node P2 according to the potential of the first node P1.

Exemplarily, the storage sub-circuit 30 may adjust the potential of the second node P2 according to the potential of the first node P1 through a coupling effect.

The driving sub-circuit 40 is respectively connected to the first node P1, the first power terminal VDD, and the second node P2, and the second node P2 may be connected to a light-emitting unit L0. The driving sub-circuit 40 may be driven by the first node P1 and the first power signal to drive the light-emitting unit L0 to emit light.

Exemplarily, when the potential of the first node P1 is the first potential, and the potential of the first power signal is the first potential, the driving sub-circuit 40 may by driven by the first node P1 and the first power signal to output a driving current to the light-emitting unit L0, thereby driving the light-emitting unit L0 to emit light.

In summary, the embodiments of the present disclosure provide a pixel circuit, since the compensation sub-circuit in the pixel circuit can output the first power signal to the first node, the storage sub-circuit can adjust the potential of the second node according to the potential of the first node. Therefore, by controlling the potential of each control signal terminal, the driving current output by the driving sub-circuit to the light-emitting unit can be independent of the threshold voltage of the transistor in the driving sub-circuit. That is, the pixel circuit provided by the embodiment of the present disclosure can compensate the threshold voltage of the transistor in the driving sub-circuit by means of internal compensation, which solves the problem that the driving current flowing through each light-emitting unit is different, which in turn leads to uneven display brightness of the display device, due to the phenomenon that the threshold voltage of the transistor in the driving sub-circuit is different or drifts, and improves the display effect of the display device.

Figure 2:
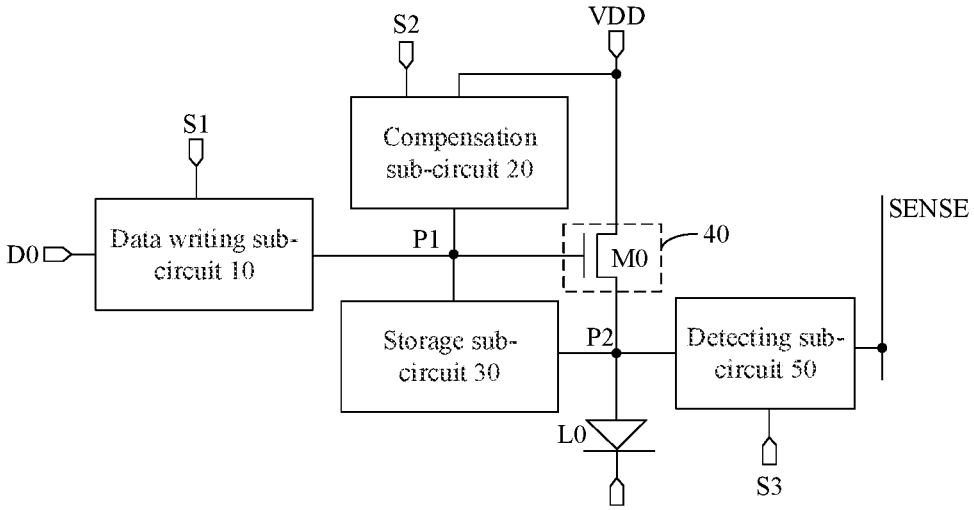
FIG. 2 is a schematic structural diagram of another pixel circuit provided by an embodiment of the present disclosure.

FIG. 2 is a schematic structural diagram of another pixel circuit provided by an embodiment of the present disclosure. As shown in FIG. 2, the pixel circuit may further include: a detecting sub-circuit 50.

The detecting sub-circuit 50 may be connected to a third control signal terminal S3, a detecting signal line SENSE, and the second node P2, respectively. The detecting sub-circuit 50 may output a detecting signal from the detecting signal line SENSE to the second node P2 and output the potential of the second node P2 to the detecting signal line SENSE in response to a third control signal provided by the third control signal terminal S3. The detecting signal line SENSE may be connected to an external compensation circuit of a display panel (not shown in FIG. 2).

In embodiments of the present disclosure, the detecting signal line SENSE may output the received potential of the second node P2 to an external compensation circuit. The external compensation circuit may adjust the potential of the data signal input to the source driving circuit according to the potential of the second node P2, so that the source driving circuit provides the data signal to the data signal terminal D0 connected to the pixel circuit according to the adjusted potential of the data signal, thereby achieving external compensation on the Vth of the transistor in the driving sub-circuit.

Exemplarily, when the potential of the third control signal is the first potential, the detecting sub-circuit 50 may output the detecting signal from the detecting signal line SENSE to the second node P2, and output the potential of the second node P2 to the detecting signal line SENSE, wherein the potential of the detecting signal is the second potential. In an embodiment of the present disclosure, the second potential may be an invalid potential, and the second potential may be a lower potential relative to the first potential.

By the pixel circuit provided by the embodiment of the present disclosure, on the one hand, by controlling the potential of each control signal terminal, the driving current output from the transistor in the driving sub-circuit to the light-emitting unit can be independent of the threshold voltage of the transistor, that is, the threshold voltage of the transistors in the driving sub-circuit can be compensated by means of internal compensation; and on the other hand, since the detecting sub-circuit can output the potential of the second node to the detecting signal lines connected to the external compensation circuit, the external compensation circuit can adjust the potential of the data signal according to the collected potential of the light-emitting unit, that is, the threshold voltage of the transistors in the driving sub-circuit can be compensated by mean of external compensation.

When the Vth of the transistors in the driving sub-circuit is shifted to a large extent, the internal compensation may not be able to effectively compensate the Vth of the transistors in the driving sub-circuit, that is, the compensation range of the internal compensation method is limited, while the Vth of the transistors in the driving sub-circuit may be effectively compensated by using external compensation. However, since the external compensation is generally performed in the blanking stage or the OFF state of a display device, when using the external compensation, the compensation time is long and the real-time performance is poor. The pixel circuit provided by the embodiment of the present disclosure can realize both the internal compensation and the external compensation on the threshold voltage of the transistor in the driving sub-circuit, so when using this pixel circuit to compensate the threshold voltage of the transistors in the driving sub-circuit, the compensation range is large, the compensation time is short, and the real-time performance is good.

Figure 3:
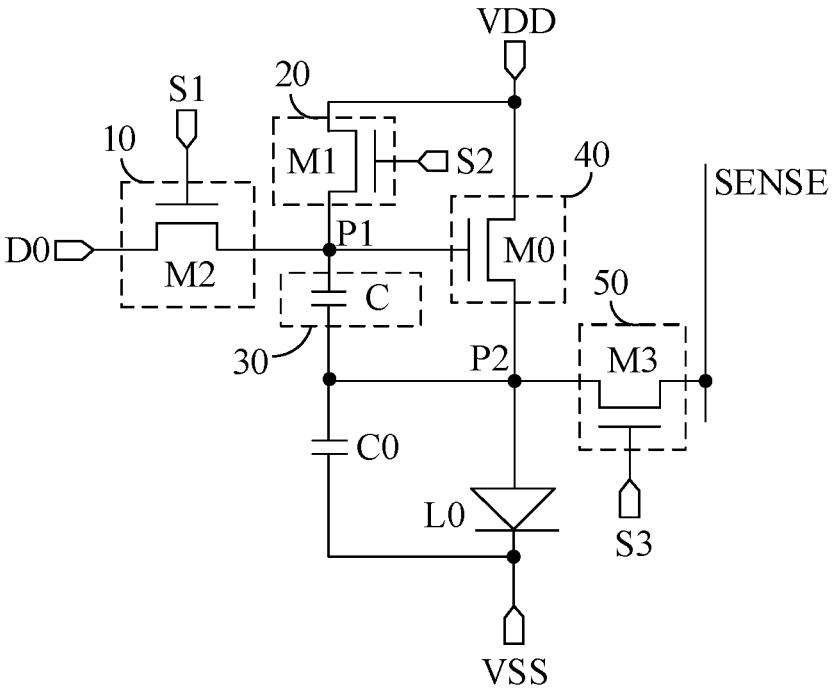
FIG. 3 is a schematic structural diagram of yet another pixel circuit provided by an embodiment of the present disclosure.

FIG. 3 is a schematic structural diagram of another pixel circuit provided by an embodiment of the present disclosure. As shown in FIG. 3, the compensation sub-circuit 20 may include: a first transistor M1.

The gate of the first transistor M1 may be connected to the second control signal terminal S2, a first electrode of the first transistor M1 may be connected to the first power terminal VDD, and a second electrode of the first transistor M1 may be connected to the first node P1.

Optionally, the data writing sub-circuit 10 may include: a second transistor M2.

The gate of the second transistor M2 may be connected to the first control signal terminal S1, a first electrode of the second transistor M2 may be connected to the data signal terminal D0, and a second electrode of the second transistor M2 may be connected to the first node P1.

Optionally, the storage sub-circuit 30 may include: a capacitor C.

One end of the capacitor C may be connected to the first node P1, and the other end of the capacitor C may be connected to the second node P2. The capacitor C may adjust the potential of the second node P2 according to the potential of the first node P1 through the coupling action.

Optionally, as shown in FIG. 3, the driving sub-circuit 40 may include: a driving transistor M0.

The gate of the driving transistor M0 may be connected to the first node P1, a first electrode of the driving transistor M0 may be connected to the first power terminal VDD, a second electrode of the driving transistor M0 may be connected to the second node P2, and the second node P2 may be connected to the light-emitting unit L0. The driving transistor M0 may be driven by the first node P1 and the first power signal to drive the light-emitting unit L0 to emit light.

Exemplarily, when the potential of the first node P1 is the first potential, and the potential of the first power signal is the first potential, the driving transistor M0 may by driven by the first node P1 and the first power signal to drive the light-emitting unit L0 to emit light.

Optionally, as shown in FIG. 3, the detecting sub-circuit 50 may include: a third transistor M3.

The gate of the third transistor M3 may be connected to the third control signal terminal S3, a first electrode of the third transistor M3 may be connected to the second node P2, and a second electrode of the third transistor M3 may be connected to the detecting signal line SENSE.

Optionally, referring to FIG. 3, it may be seen that the pixel circuit may further include: an intrinsic capacitor C0 of the light-emitting unit L0. One end of the intrinsic capacitor C0 may be connected to the second node P2, the other end of the intrinsic capacitor C0 may be connected to one end of the light-emitting unit L0 (e.g., the cathode of the light-emitting unit L0), and the cathode of the light-emitting element L0 may also be connected to a low-level power terminal VSS. The other end of the fight-emitting unit L0 (e.g., the anode of the light-emitting unit L0) may be connected to the second electrode of the driving transistor M0.

Optionally, each of the transistor included in the data writing sub-circuit 10, the transistor included in the compensation sub-circuit 20, the transistor included in the storage sub-circuit 30, the transistor included in the detecting sub-circuit 50 and the driving transistor M0 may be a N-type transistor. And each of the transistors may be an oxide thin film transistor (TFT), or each of the transistors may be amorphous silicon (A-Si) TFT, which is not limited in the embodiment of the present disclosure.

In summary, the embodiments of the present disclosure provide a pixel circuit, since the compensation sub-circuit in the pixel circuit can output the first power signal to the first node (the gate of the driving transistor), the storage sub-circuit can adjust the potential of the second node (the second electrode of the driving transistor) according to the potential of the first node. Therefore, by controlling the potential of each control signal terminal, the driving current output by the driving transistor to the light-emitting unit can be independent of the threshold voltage of the driving transistor, that is, the threshold voltage of the driving transistor can be compensated by means of internal compensation.

Furthermore, since the detecting sub-circuit can output the potential of the second node to the detecting signal lines connected to the external compensation circuit, the external compensation circuit can adjust the voltage of the data signal according to the collected potential of the light-emitting unit, that is, the threshold voltage of the driving transistor can be compensated by the external compensation method, which solves the problem that the driving current flowing through each light-emitting unit is different, which leads to uneven display brightness of the display device, due to the phenomenon that the threshold voltages of the driving transistors in different pixel units are different or the threshold voltage of the driving transistor drifts, and improves the display effect of the display device.

In addition, since the pixel circuit can realize both internal compensation and external compensation on the threshold voltage of the driving transistor, when the pixel circuit compensates the threshold voltage of the driving transistor, the compensation range is large, the compensation time is short, and the real-time performance is good.

Figure 4:
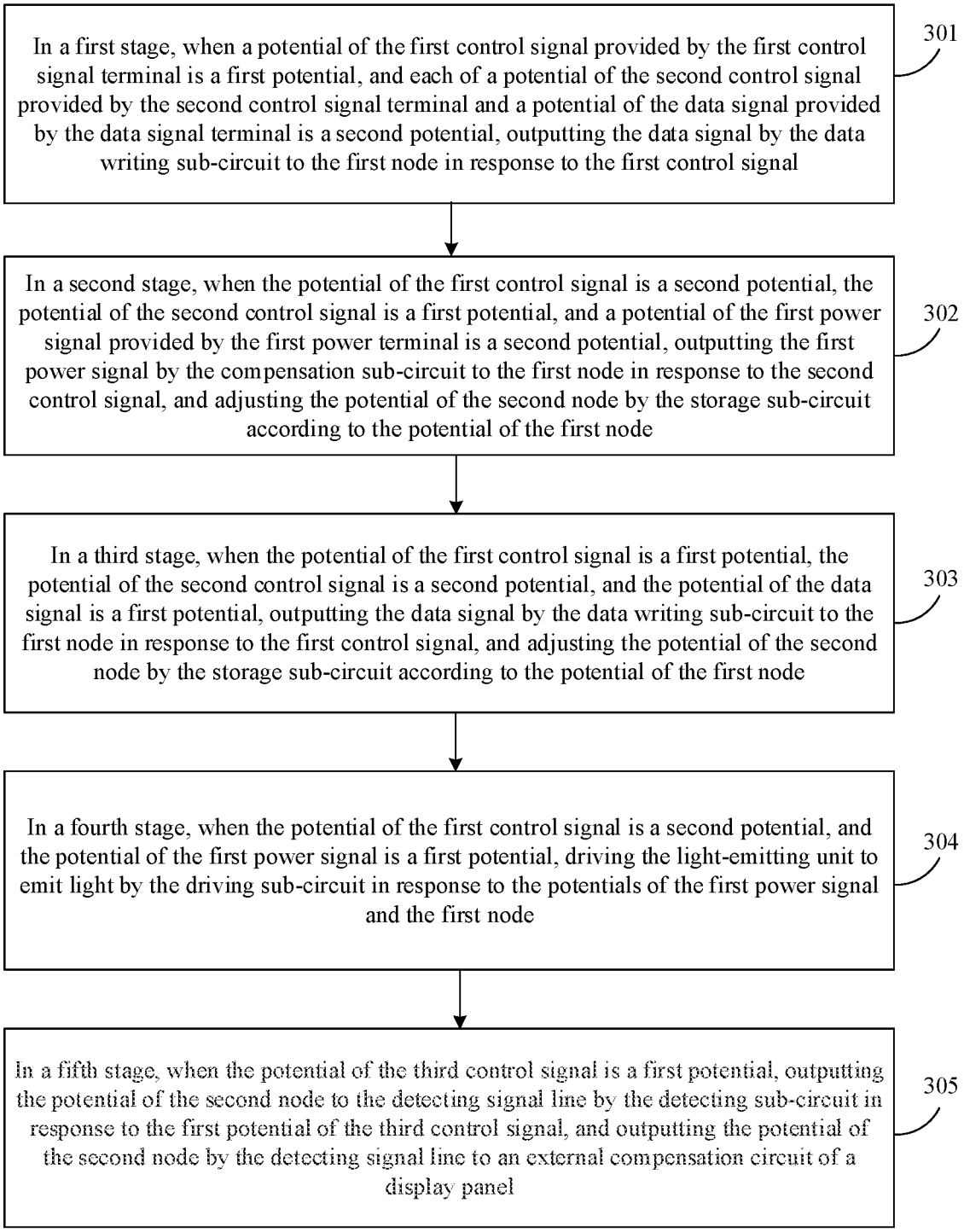
FIG. 4 is a flowchart of a driving method of a pixel circuit provided by an embodiment of the present disclosure.

FIG. 4 is a flowchart of a driving method of a pixel circuit provided by an embodiment of the present disclosure, which may be applied to the pixel circuit shown in any one of FIGS. 1 to 3. As shown in FIG. 4, the method may include the following steps.

In step 301, in a first stage: when the potential of the first control signal provided by the first control signal terminal is a first potential, and the potential of the second control signal provided by the second control signal terminal and the potential of the data signal provided by the data signal terminal is a second potential, the data signal is output by the data writing sub-circuit to the first node in response to the first control signal, thereby realizing the reset of the first node.

In step 302, in a second stage: when the potential of the first control signal is the second potential, the potential of the second control signal is the first potential, and the potential of the first power signal provided by the first power terminal is the second potential, the first power signal is output by the compensation sub-circuit to the first node in response to the second control signal, and the potential of the second node is adjusted by the storage sub-circuit according to the potential of the first node.

In step 303, in a third stage: when the potential of the first control signal is the first potential, the potential of the second control signal is the second potential, and the potential of the data signal is the first potential, the data signal is output by the data writing sub-circuit to the first node in response to the first control signal, and the potential of the second node is adjusted by the storage sub-circuit according to the potential of the first node.

In step 304, in a fourth stage: when the potential of the first control signal is the second potential, and the potential of the first power signal is a first potential, the light-emitting unit is driven to emit light by the driving sub-circuit in response to the potentials of the first power signal and the first node.

In summary, the embodiments of the present disclosure provide a driving method of a pixel circuit. Since the compensation sub-circuit can output the first power signal to the first node, the storage sub-circuit can adjust the potential of the second node according to the potential of the first node. Therefore, by controlling the potential of each control signal terminal, the driving current output by the transistors in the driving sub-circuit to the light-emitting unit can be independent of the threshold voltage of the transistor in the driving sub-circuit, i.e., the threshold voltage of the transistor in the driving sub-circuit can be compensated by means of internal compensation. That is, the pixel circuit provided by the embodiment of the present disclosure can compensate the threshold voltage of the transistor in the driving sub-circuit by means of internal compensation, which solves the problem that the driving current flowing through each light-emitting unit is different, which in turn leads to uneven display brightness of the display device, due to the phenomenon that the threshold voltage of the transistor in the driving sub-circuit is different or drifts, and improves the display effect of the display device.

Optionally, in an embodiment of the present disclosure, referring to FIG. 2 and FIG. 3, the pixel circuit may further include a detecting sub-circuit 50. The detecting sub-circuit 50 may be connected to the third control signal terminal S3, the detecting signal line SENSE, and the second node P2, respectively.

In the first stage shown in step 301, the potential of the third control signal provided by the third control signal terminal is the first potential, and the potential of the detecting signal provided by the detecting signal line is the second potential. The detecting sub-circuit 50 may output the detecting signal to the second node in response to the third control signal, so as to implement reset of the second node.

Optionally, as shown in FIG. 4, the method may further include the following step.

In step 305, in a fifth stage: when the potential of the third control signal is the first potential, the potential of the second node is output to the detecting signal line by the detecting sub-circuit in response to the third control signal, and the potential of the second node is output by the detecting signal line to an external compensation circuit of the display panel.

In embodiments of the present disclosure, the detecting sub-circuit can output the potential of the second node to the detecting signal lines connected to the external compensation circuit, so the external compensation circuit can adjust the potential of the data signal according to the collected potential of the light-emitting unit, that is, the threshold voltage of the transistor in the driving sub-circuit can be compensated by means of the external compensation. Since the pixel circuit can realize both internal compensation and external compensation on the threshold voltage of the transistor in the driving sub-circuit, when the pixel circuit compensates the threshold voltage of the transistor in the driving sub-circuit, the compensation range is large, the compensation time is short, and the real-time performance is good.

In embodiments of the present disclosure, the fifth stage may be running in the blanking stage of the display panel, that is, the Vth of the transistors in the driving sub-circuits may be compensated in the blanking stage by means of the external compensation. For example, the fifth stage may be running in the vertical blanking (VBlank) stage of the display panel.

Optionally, after entering the blanking stage, before running the fifth stage, the method may further include: sequentially running the first stage, the second stage, and the third stage.

That is, after entering the blanking stage, before performing external compensation on the Vth of the transistor in the driving sub-circuit, the potential of the second node (that is, the potential of the light-emitting unit) can be adjusted by running the first stage to the third stage. After that, the fifth stage is running to execute the external compensation. Thereby, the detecting signal line can output the adjusted potential of the second node to the external compensation circuit, so that the external compensation circuit can accurately adjust the potential of the data signal according to the adjusted potential of the second node, and improve accuracy of the external compensation.

Now an example is given to describe in detail the driving principle of the pixel circuit provided by the embodiment of the present disclosure, wherein the pixel circuit is that shown in FIG. 3, the driving transistor M0, a first transistor M1, the second transistor M2 and the third transistor M3 are all N-type transistors, and the first potential is a high potential relative to the second potential (that is, the potential of the signal of the first potential is greater than that of the signal of the second potential).

Figure 5:
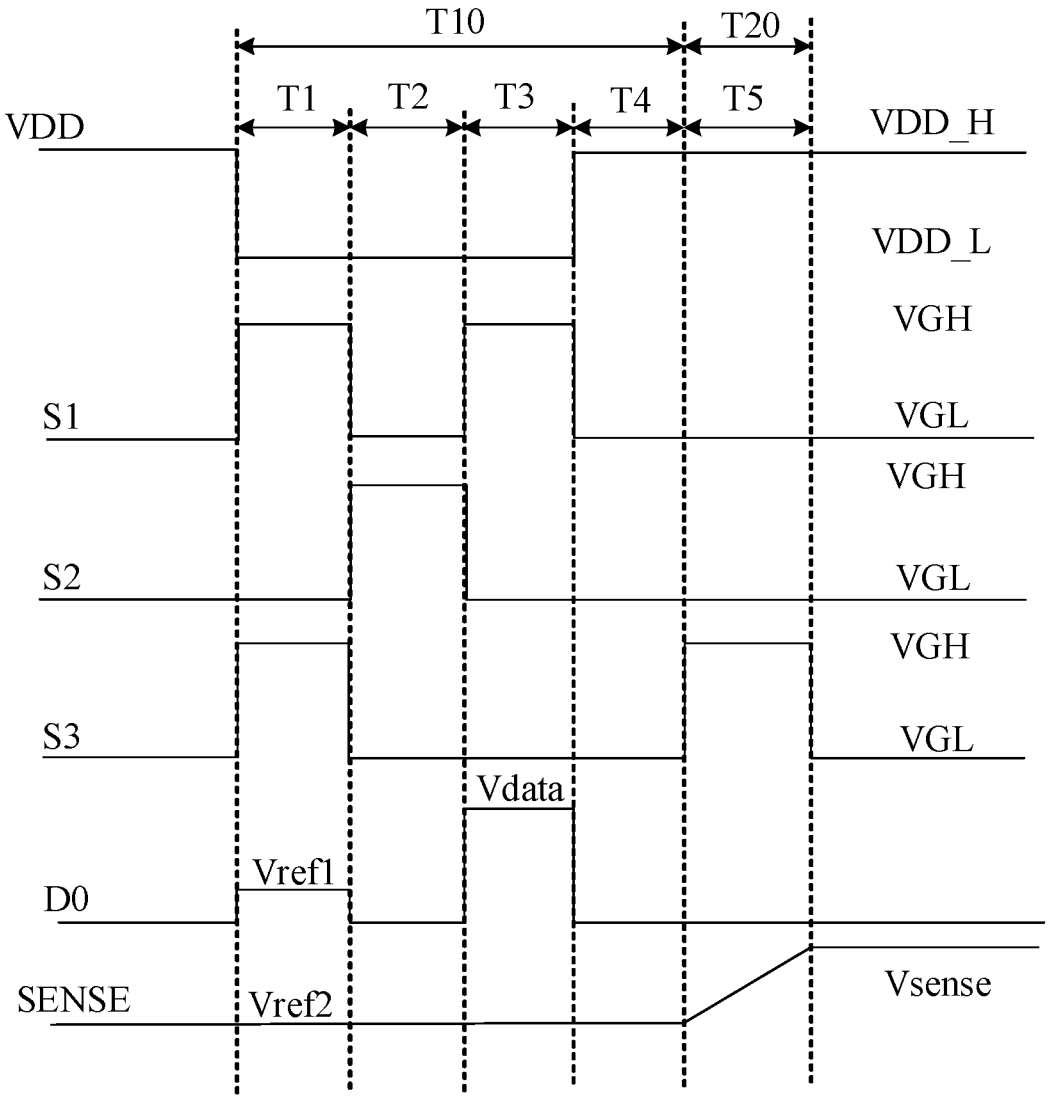
FIG. 5 is a timing diagram of each signal terminal in a pixel circuit provided by an embodiment of the present disclosure.

FIG. 5 is a timing diagram of each signal terminal in a pixel circuit provided by an embodiment of the present disclosure. As shown in FIG. 5, in the first stage T1, the potential of the data signal provided by the data signal terminal D0 and the potential of the detecting signal provided by the detecting signal line SENSE are the second potential. The potential of the first control signal provided by the first control signal terminal S1 and the potential of the third control signal provided by the third control signal terminal S3 are both the first potential, and the potential of the second control signal provided by the second control signal terminal S2 is the second potential. For example, the potential of the first control signal and the potential of the third control signal are both positive potentials, and the potential of the second control signal is a negative potential. The second transistor M2 and the third transistor M3 are turned on, and the first transistor M1 is turned off. The data signal terminal D0 outputs the data signal at the second potential to the first node P1 through the second transistor M2, so that the first node P1 is reset. The detecting signal line SENSE outputs the detecting signal at the second potential to the second node P2 through the third transistor M3, thereby realizing the reset of the second node P2. The first stage T1 may also be referred to as a reset stage.

In embodiments of the present disclosure, in the first stage T1, the potential Vref1 of the data signal and the potential Vref2 of the detecting signal may be the same, for example, 0 to 3 volts (V).

For example, assuming that in the first stage T1, the potential Vref1 of the data signal and the potential Vref2 of the detecting signal are 0V, then in the first stage T1, the potential $V_{P1}$ of the first node P1 and the potential $V_{P2}$ of the second node P2 satisfy the follows: $V_{P1}=V_{P2}=0V$.

In the second stage T2, the potential of the first power signal provided by the first power terminal VDD is the second potential, the potentials of the first control signal and the third control signal both jump to the second potential, and the potential of the second control signal jumps to the first potential. The second transistor M2 and the third transistor M3 are turned off, and the first transistor M1 is turned on. The first power terminal VDD outputs the first power signal at the second potential to the first node P1 through the first transistor M1. Since the first electrode of the driving transistor M0 is also connected to the first power terminal VDD, and the gate of the driving transistor M0 is connected to the first node P1, in the second stage T2, the potentials of the gate and the first electrode of the driving transistor M0 are the same, and the connection mode of the driving transistor M0 becomes the diode connection mode. The potential of the second electrode (i.e., the second node P2) of the driving transistor M0 is: the difference between the potentials of the first node P1 and the threshold voltage Vth of the driving transistor M0. The second stage T2 may be referred to as an internal compensation stage.

For example, assuming that the potential of the first power signal is VDD_L, then in the second stage T2, the potential $V_{P1}$ of the first node is: $V_{P1}$=VDD_L. Correspondingly, the potential $V_{P2}$ of the second node P2 is: $V_{P2}$=VDD_L−Vth.

It is noted that, in the second stage T2, in order to avoid the leakage light of the light-emitting unit L0, the potential $V_{P2}$ of the second node P2 should be smaller than the turn-on voltage $V_{OLED}$ of the light-emitting unit L0. Correspondingly, the potential of the first power signal T2 in the second stage T2 is VDD_L, which should satisfy the follows: VDD_L<$V_{OLED}$+Vth. Further, in the second stage T2, in order to achieve diode-compensation, the potential of the first power signal is VDD_L, which should also satisfy the follows: VDD_L>Vref2+Vth. That is, in the second stage T2, the potential VDD_L of the first power signal may satisfy the follows: Vref2+Vth<VDD_L<$V_{OLED}$+Vth.

If the light-emitting unit L0 is a monochrome OLED, the turn-on voltage $V_{OLED}$ is generally about 3V. If the light-emitting unit L0 is a two-layer White OLED (WOLED), the turn-on voltage $V_{OLED}$ is generally about 5V. If the light-emitting unit L0 is a triple-layer WOLED, the turn-on voltage $V_{OLED}$ is generally about 8V.

Exemplarily, assuming that the light-emitting unit L0 is a monochrome OLED, Vref2=0V, and Vth is 0 to 1V, the potential VDD_L of the first power signal in the second stage T2 may be about 2V.

In the third stage T3, the potential of the data signal jumps to the first potential, the potential of the first control signal jumps to the first potential, the potential of the second control signal jumps to the second potential, and the potential of the third control signal remains at the second potential. The first transistor M1 and the third transistor M3 are turned off, and the second transistor M2 is turned on. The data signal terminal D0 outputs the data signal at the first potential to the first node P1 through the second transistor M2. This third stage T3 may also be referred to as a data writing stage.

For example, assuming that the potential of the data signal is Vdata, then in the third stage T3, the potential $V_{P1}$ of the first node P1 is: $V_{P1}$=Vdata. Since in the second stage T2, the potential $V_{P1}$ of the first node P1 is: $V_{P1}$=VDD_L, in the third stage T3, the potential variation of the first node P1 is: Vdata−VDD_L. Since the pixel circuit also includes the intrinsic capacitor C0 of the light-emitting unit L0, upon the coupling effect of the capacitor C, the potential variation of the second node P2 is: α(Vdata−VDD_L), wherein a satisfies the follows: α=C/(C0+C). And, in the second stage T2, the potential of the second node P2 becomes: $V_{P2}$=VDD_L−Vth, therefore, in the third stage T3, the capacitor C may adjust the potential $V_{P2}$ of the second node P2 to: $V_{P2}$=α(Vdata−VDD_L)+VDD_L−Vth through the coupling effect.

In the fourth stage T4, the potential of the first power signal jumps to the first potential, the potential of the first control signal also jumps to the second potential, and the potential of the second control signal and the potential of the third control signal remain the second potential. The first transistor M1, the second transistor M2, and the third transistor M3 are all turned off. At this time, the driving transistor M0 may be controlled by the first node P1 and the first power signal to output a driving current to the light-emitting element L0 to drive the light-emitting element L0 to emit light. The fourth stage T4 may also be referred to as a display stage.

For example, referring to FIG. 4, in the fourth stage T4, the potential of the first power signal may be VDD_H. In the third stage T3, the potential $V_{P1}$ of the first node is: $V_{P1}$=Vdata, the potential $V_{P2}$, of the second node P2 is: $V_{P2}$α(Vdata−VDD_L)+VDD_L−Vth, the gate of the driving transistor M0 is connected to the first node P1, and the second electrode (i.e., the source) of the driving transistor M0 is connected to the second node P2, therefore in the fourth stage T4, the gate-source voltage Vgs (that is, the potential difference between the gate potential Vg and the source potential Vs) of the driving transistor M0 is:

$$Vgs = Vg - Vs = Vp1 - Vp2 = Vdata - [\alpha(Vdata - VDD_L) + VDD_L - Vth] = (1-\alpha)(Vdata - VDD_L) + Vth; \quad \text{Formula (1)}$$

Wherein, the driving current I generated by the driving transistor M0 may be expressed as:

$$I = K \times (Vgs - Vth)^2 \quad \text{Formula (2).}$$

K satisfied the follows:

$$K = \frac{1}{2} \times \frac{W}{L} \times C_{ox} \times \mu,$$

wherein μ is the carrier mobility of the (hiving transistor M0, $C_{OX}$ is the capacitor of the gate insulating layer of the driving transistor M0, and W/L is the width to length ratio of the driving transistor M0.

Substituting the Vgs obtained by the above formula (1) into the formula (2), the drive current I generated by the driving transistor M0 may be calculated as:

$$\begin{aligned} I &= K \times (Vgs - Vth)^2 \\ &= K \times [(1-\alpha)(Vdata - VDD_L) + Vth - Vth]^2 \\ &= K \times [(1-\alpha)(Vdata - VDD_L)]^2. \end{aligned} \quad \text{Formula (3)}$$

It may be seen from the above formula (3) that when the light-emitting element L0 operates normally, the magnitude of the drive current I for driving the fight-emitting element L0 is only related to the potential Vdata of the data signal provided by the data signal terminal D0 and the potential VDD_L of the first power signal provided by the first power terminal VDD, and is not related to the threshold voltage Vth of the driving transistor. Therefore, in the display stage, the pixel circuit can compensate the Vth of the driving transistor M0 by means of the internal compensation, which can avoid the problem of uneven display brightness of the display panel caused by the shift of the Vth of the driving transistor M0, and effectively ensure the uniformity of display brightness of the display panel.

Optionally, the potential VVD_L of the first power signal may be small, so that it can be ensured that the time required for the potential of the second node P2 to become: $V_{P2}$=VDD_L−Vth is shorter, which can shorten the internal compensation time.

In the fifth stage T5, the potential of the third control signal jumps to the second potential, and the potentials of the first control signal and the second control signal remain at the first potential. The first transistor M1 and the second transistor M2 are turned off, and the third transistor M3 is turned on. The potential of the second node P2 is output to the detecting signal line SENSE through the third transistor M3. Now referring to FIG. 4, the potential Vsense on the detecting signal line SENSE gradually rises. And in the embodiment of the present disclosure, the detecting signal line SENSE may output the potential of the second node P2 to an external compensation circuit, and the external compensation circuit may adjust the potential of the data signal input to the source driving circuit according to the potential of the second node P2, so that the source driving circuit provides a data signal to the data signal terminal D0 connected to the pixel circuit according to the adjusted potential of the data signal, thereby achieving external compensation on the Vth of the driving transistor M0. This fifth stage T5 may also be referred to as an external compensation stage.

Moreover, in the fifth stage T5, the external compensation circuit may also determine the magnitude of the electron mobility of the driving transistor M0 according to the collected driving currents output by different driving transistors M0 to the light-emitting unit L0. After adjusting the potential of the data signal, the electron mobility of the driving transistor M0 can also be compensated.

In an embodiment of the present disclosure, referring to FIG. 4, the first to fourth stages T1 to T4 may be running at the display stage T10 of the display panel, and the fifth stage T5 may be running at the blanking stage T20 of the display panel.

Figure 6:
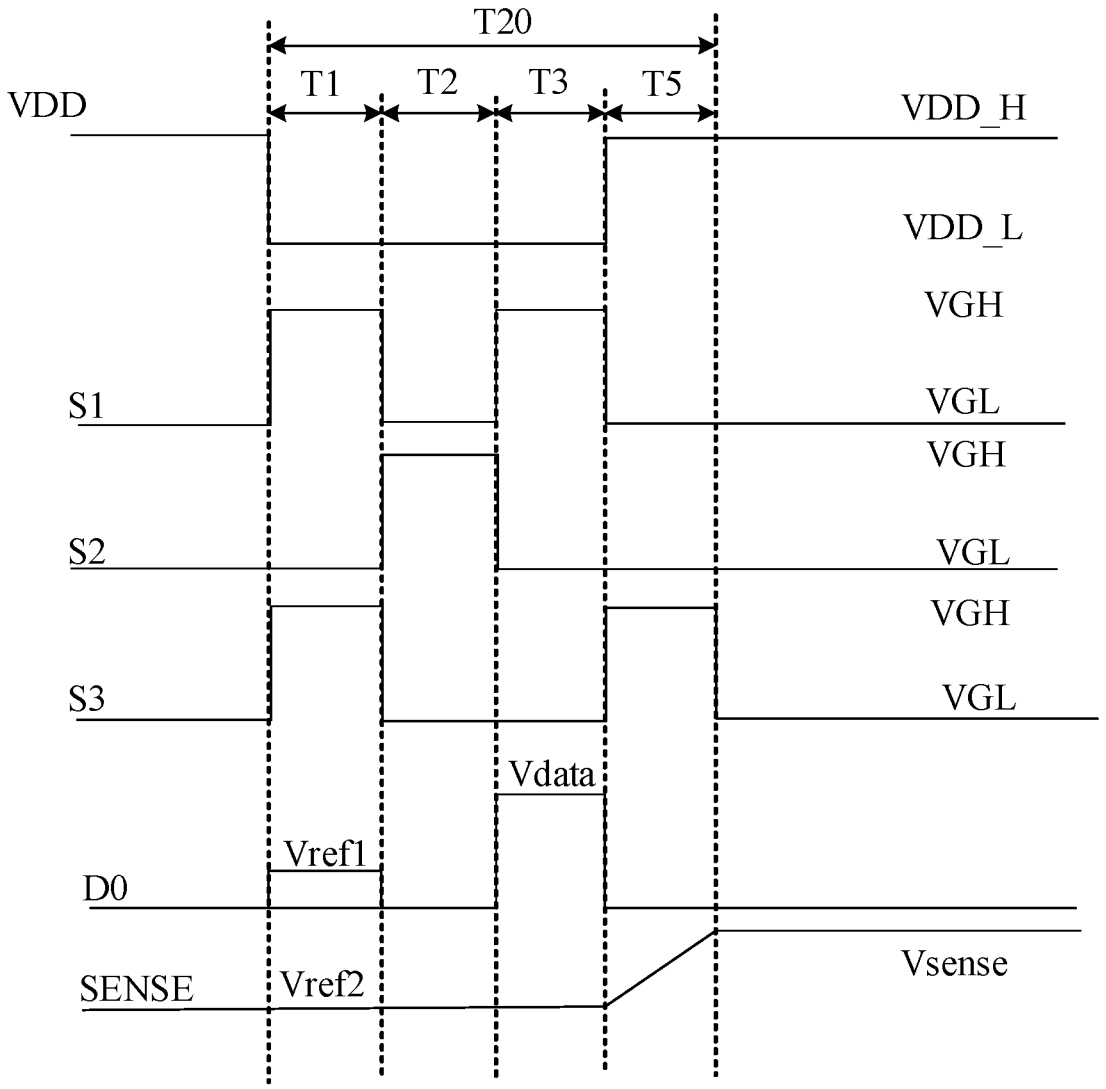
FIG. 6 is a timing diagram of each signal terminal in another pixel circuit provided by an embodiment of the present disclosure.

Optionally, after entering the blanking stage and before running the fifth stage T5, the first stage T1, the second stage T2, and the third stage T3 may be running in sequence at first. FIG. 6 is another timing diagram at the blanking stage of each signal terminal provided by an embodiment of the present disclosure. As shown in FIG. 6, in the blanking stage T20 and before the fifth stage T5, it may further include a first stage T1, a second stage T2, and a third stage T3. For the driving principles of the first stage T1, the second stage T2, the third stage T3 and the fifth stage T5, reference may be made to the above description, and no further description will be given here.

In summary, the embodiments of the present disclosure provide a driving method for a pixel circuit. On the basis of the driving method, the compensation sub-circuit can output a first power signal to the first node, and the storage sub-circuit can adjust the potential of the second node according to the potential of the first node. Therefore, by controlling the potential of each control signal terminal, the drive current output from the transistor in the driving sub-circuit to the light-emitting unit can be independent of the threshold voltage of the transistor, that is, the threshold voltage of the transistor in the driving sub-circuit can be compensated by means of the internal compensation.

Moreover, since the detecting sub-circuit can output the potential of the second node to the detecting signal lines connected to the external compensation circuit, the external compensation circuit can adjust the potential of the data signal according to the collected potential of the light-emitting unit, that is, the threshold voltage of the transistors in the driving sub-circuit can be compensated by mean of external compensation, which solves the problem that the driving current flowing through each light-emitting unit is different, which in turn leads to uneven display brightness of the display device, due to the phenomenon that the threshold voltages of the transistors in different driving sub-circuits are different or the threshold voltage of the transistor in the driving sub-circuit drifts, and improves the display effect of the display device.

In addition, since the driving method of the pixel circuit provided by the embodiment of the present disclosure can realize both the internal compensation and the external compensation of the threshold voltage of the transistor in the driving sub-circuit, the compensation range is large, the compensation time is short, and the real-time performance is good.

Figure 7:
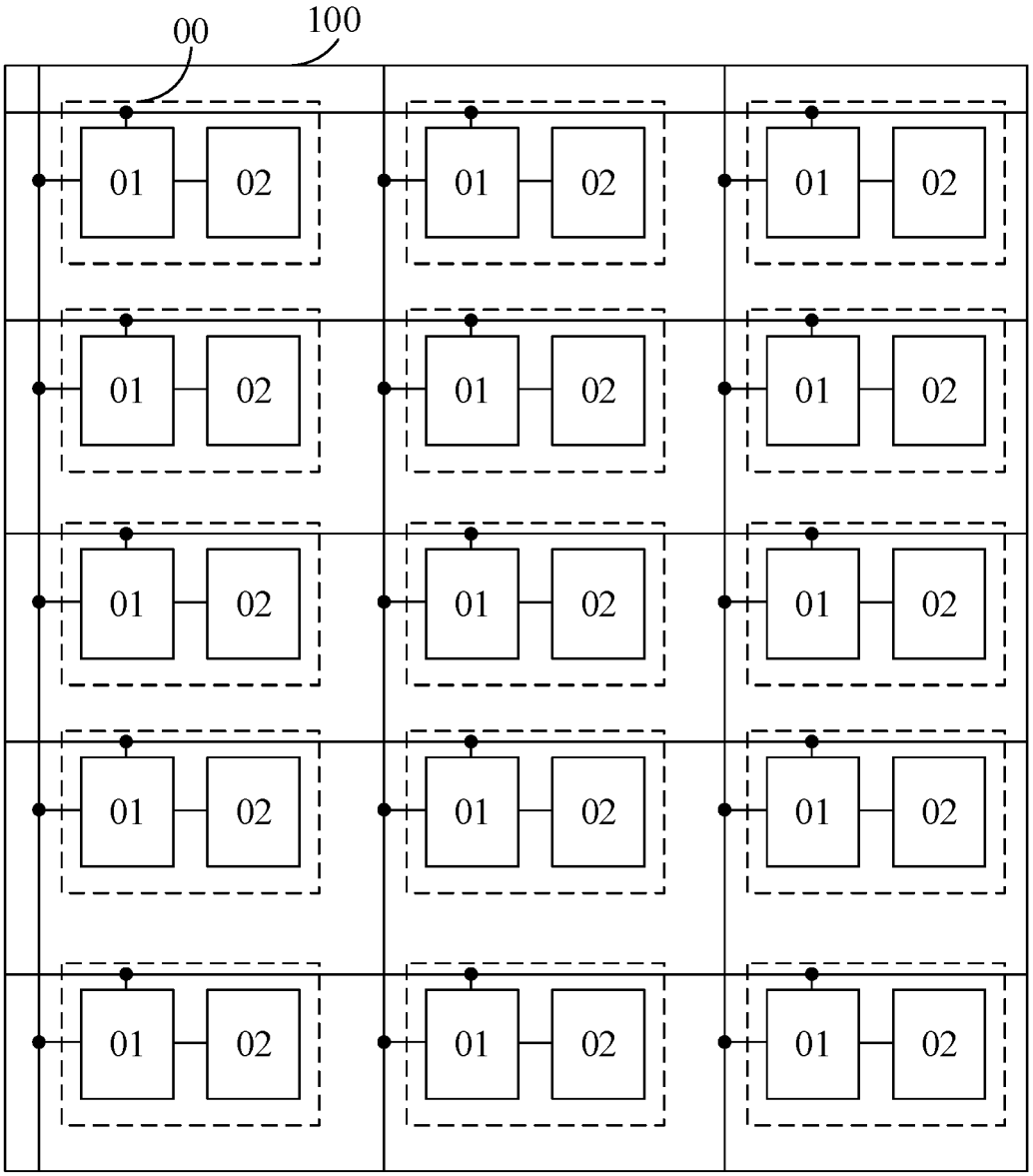
FIG. 7 is a schematic structural diagram of a display panel provided by an embodiment of the present disclosure.

An embodiment of the present disclosure also provides a display panel. As shown in FIG. 7, the display panel 100 may include: a plurality of pixel units 00, and each pixel unit 00 may include: a pixel circuit 01 and a light-emitting unit 02 connected to the pixel circuit 01. The pixel circuit 01 may be a pixel circuit as shown in any one of FIGS. 1 to 3. The light-emitting unit 02 may be an OLED or an AMOLED.

Figure 8:
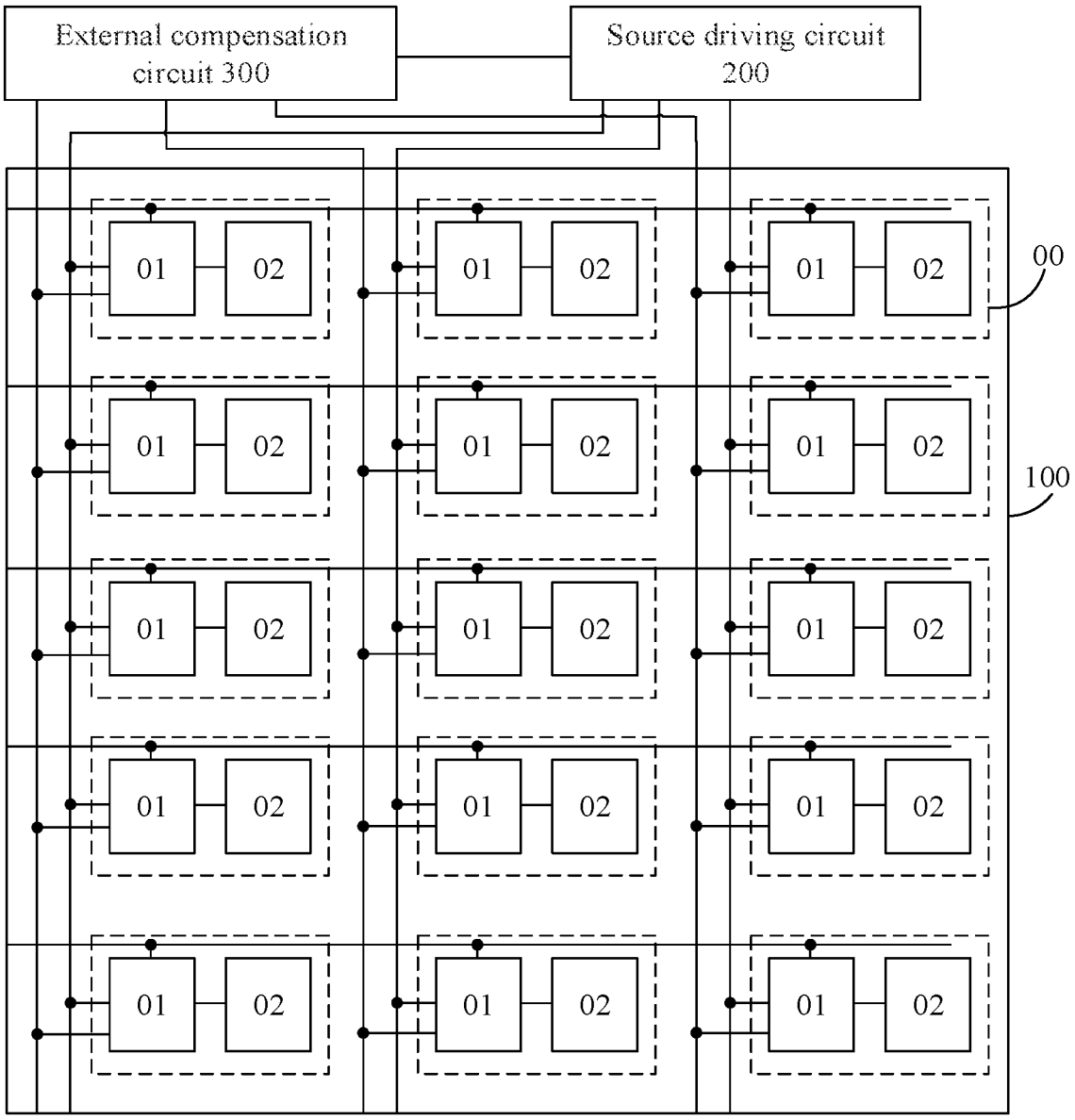
FIG. 8 is a schematic structural diagram of a display device provided by an embodiment of the present disclosure.

An embodiment of the present disclosure also provides a display device. As shown in FIG. 8, the display device may include: a display panel 100 and a source driving circuit 200. The display panel 100 may be the display panel shown in FIG. 7. The source driving circuit 200 may be connected to the data signal terminal connected to each pixel circuit 01 in the display panel 100 respectively. The source driving circuit 200 may be used to provide a data signal to the data signal terminal.

Optionally, each pixel circuit 01 further includes a detecting sub-circuit, which is connected to a detecting signal line. As shown in FIG. 8, the display device may further include: an external compensation circuit 300.

Each of the detecting signal lines connected to the detecting sub-circuit in each pixel circuit 01 may be connected to the external compensation circuit 300. The detecting sub-circuit in each pixel circuit 01 may output the potential of the second node in the pixel circuit 01 to the external compensation circuit 300 through the detecting signal line.

The external compensation circuit 300 may adjust the potential of the data signal input to the source driving circuit 200 according to the potential of the second node. The source (driving circuit 200 may provide a data signal to the data signal terminal according to the adjusted potential of the data signal, thereby achieving external compensation on the threshold voltage of the driving transistor.

As shown in FIG. 8, the detecting sub-circuits in the pixel circuits 01 in the pixel units 00 in the same column may be connected to the same detecting signal line.

Optionally, in an embodiment of the present disclosure, the display device may further include a plurality of pixels, and each pixel includes a plurality of adjacent pixel units 00. The detecting sub-circuits in adjacent pixel units 00 may be connected to the same detecting signal line.

Exemplarily, assuming that each pixel 00 includes three adjacent pixel units (the three pixel units may be red pixel unit, green pixel unit, and blue pixel unit), The detecting sub-circuits in the three pixel circuits included in the adjacent three pixel units may be connected to the same detecting signal line.

If the three pixel units included in each pixel 00 are arranged in a row, each detecting signal line may be connected to the detecting sub-circuits in the three column of pixel units. For example, if the display panel includes 1000 columns of pixels, and each pixel includes three pixel units arranged in rows, each detecting signal line may be connected to detecting sub-circuits in pixel circuits of 3000 pixel units. By connecting each detecting signal line to the pixel circuits of multiple columns of pixel units, the number of detecting signal lines required to be provided in the display device can be effectively reduced, thereby reducing the occupied space of the detecting signal lines.

Optionally, the display device may be: an OLED display device, an AMOLED display device, a mobile phone, a tablet computer, a TV, a display, a notebook computer, a digital photo frame, a navigator, and any other products or components with display functions.

Those skilled in the art may clearly understand that for the convenience and conciseness of the description, the specific working processes of the pixel circuit and the display device described above may be obtained by referring to the corresponding processes in the foregoing method embodiments, which are not repeated here.

The foregoing descriptions are merely exemplary embodiments of the present disclosure, and are not intended to limit the present disclosure. Within the spirit and principles of the disclosure, any modifications, equivalent substitutions, improvements, etc., are within the protection scope of the present disclosure.

What is claimed is:

1. A pixel circuit comprising: a data writing sub-circuit, a compensation sub-circuit, a storage sub-circuit and a driving sub-circuit, wherein the data writing sub-circuit is connected to a first control signal terminal, a data signal terminal and a first node, respectively, and the data writing sub-circuit is used to output a data signal from the data signal terminal to the first node in response to a first control signal provided by the first control signal terminal in a first stage, so that a voltage of the first node is reset to a voltage of the data signal in the first stage;

the storage sub-circuit is connected to the first node and a second node, respectively;

the driving sub-circuit comprises a driving transistor, a gate of the driving transistor is connected to the first node, a first electrode of the driving transistor is connected to the first power terminal, and a second electrode of the driving transistor is connected to the second node, wherein the first electrode and the second electrode are one of a source and a drain, respectively;

the compensation sub-circuit is connected to a second control signal terminal, a first power terminal and the first node, respectively, and the compensation sub-circuit is used to output a first power signal from the first power terminal to the first node in response to a second control signal provided by the second control signal terminal in a second stage, so that the storage sub-circuit adjusts a potential of the second node to a value equal to the voltage of the first node minus a threshold voltage of the drive transistor in the second stage;

the data writing sub-circuit is further used to output the data signal from the data signal terminal to the first node in response to the first control signal provided by the first control signal terminal in a third stage, so that the storage sub-circuit increases the voltage of the first node and a voltage of the second node by a value proportional to a difference between a voltage of the first power signal and the voltage of the data signal in the third stage; and the storage sub-circuit is used to remain a difference between the voltage of the first node and the voltage of the second node unchanged in a fourth stage in which the first control signal and the second control signal are not provided, so that the drive sub-circuit provides a drive current whose current value is not related to the threshold voltage of the driving transistor, to drive a light-emitting unit.

2. The pixel circuit according to claim 1, wherein the compensation sub-circuit comprises: a first transistor;

the gate of the first transistor is connected to the second control signal terminal, a first electrode of the first transistor is connected to the first power terminal, and a second electrode of the first transistor is connected to the first node, wherein the first electrode and the second electrode are one of a source and a drain, respectively.

3. The pixel circuit according to claim 1, wherein the data writing sub-circuit comprises: a second transistor;

a gate of the second transistor is connected to the first control signal terminal, a first electrode of the second transistor is connected to the data signal terminal, and a second electrode of the second transistor is connected to the first node, wherein the first electrode and the second electrode are one of a source and a drain, respectively.

4. The pixel circuit according to claim 1, wherein the storage sub-circuit comprises a capacitor;

one end of the capacitor is connected to the first node, and the other end of the capacitor is connected to the second node.

5. The pixel circuit according to claim 1, wherein the pixel circuit further comprises a detecting sub-circuit;

the detecting sub-circuit is connected to a third control signal terminal, a detecting signal line and the second node, respectively, and the detecting sub-circuit is used to output a detecting signal from the detecting signal line to the second node and output a potential of the second node to the detecting signal line in response to a third control signal provided by the third control signal terminal, the detecting signal line being connected to an external compensation circuit of a display panel.

6. The pixel circuit according to claim 5, wherein the detecting sub-circuit comprises a third transistor;

a gate of the third transistor is connected to the third control signal terminal, a first electrode of the third transistor is connected to the second node, and a second electrode of the third transistor is connected to the detecting signal line, wherein the first electrode and the second electrode are one of a source and a drain, respectively.

7. The pixel circuit according to claim 1, wherein each transistor in the pixel circuit is a N-type transistor.

8. The pixel circuit according to claim 6, wherein the compensation sub-circuit comprises a first transistor; the data writing sub-circuit comprises a second transistor; and the storage sub-circuit comprises a capacitor;

a gate of the first transistor is connected to the second control signal terminal, a first electrode of the first transistor is connected to the first power terminal, and a second electrode of the first transistor is connected to the first node;

a gate of the second transistor is connected to the first control signal terminal, a first electrode of the second transistor is connected to the data signal terminal, and a second electrode of the second transistor is connected to the first node; and one end of the capacitor is connected to the first node, and the other end of the capacitor is connected to the second node;

wherein, each transistor is a N-type transistor, wherein the first electrode and the second electrode are one of a source and a drain, respectively.

9. A driving method of the pixel circuit according to claim 1, comprising:

in the first stage, when a potential of the first control signal provided by the first control signal terminal is a first potential, and each of a potential of the second control signal provided by the second control signal terminal and a potential of the data signal provided by the data signal terminal is a second potential, outputting the data signal by the data writing sub-circuit to the first node in response to the first potential of the first control signal;

in the second stage, when the potential of the first control signal is a second potential, the potential of the second control signal is a first potential, and a potential of the first power signal provided by the first power terminal is a second potential, outputting the first power signal by the compensation sub-circuit to the first node in response to the first potential of the second control signal, and adjusting the potential of the second node by the storage sub-circuit according to the potential of the first node;

in the third stage, when the potential of the first control signal is a first potential, the potential of the second control signal is a second potential, and the potential of the data signal is a first potential, outputting the data signal by the data writing sub-circuit to the first node in response to the first potential of the first control signal, and adjusting the potential of the second node by the storage sub-circuit according to the potential of the first node; and in the fourth stage, when the potential of the first control signal is a second potential, and the potential of the first power signal is a first potential, driving the light-emitting unit to emit light by the driving sub-circuit in response to the potentials of the first power signal and the first node.

10. The method according to claim 9, wherein the pixel circuit further comprises a detecting sub-circuit; and the method further comprises:

in the first stage, when a potential of the third control signal provided by the third control signal terminal is a first potential, and a potential of the detecting signal provided by the detecting signal line is a second potential, outputting the detecting signal to the second node by the detecting sub-circuit in response to the first potential of the third control signal.

11. The method according to claim 10, further comprising:

in a fifth stage, when the potential of the third control signal is a first potential, outputting the potential of the second node to the detecting signal line by the detecting sub-circuit in response to the first potential of the third control signal, and outputting the potential of the second node by the detecting signal line to an external compensation circuit of a display panel.

12. The method according to claim 11, wherein the fifth stage is in the blanking stage of the display panel.

13. The method according to claim 12, wherein after entering the blanking stage and before entering the fifth stage, the method further comprises:

running the first stage, the second stage, and the third stage sequentially.

14. The method according to claim 9, each first potential is a high potential and each second potential is a low potential.

15. A display panel comprising: a plurality of pixel units, each of the pixel units comprises: the pixel circuit according to claim 1, and a light-emitting unit connected to the pixel circuit.

16. A display device comprising: a source driving circuit, and the display panel according to claim 15; wherein the source driving circuit is connected to a data signal terminal connected with each pixel circuit in the display panel, respectively, and the source driving circuit is used to provide a data signal to the data signal terminal of each pixel circuit.

17. The display device according to claim 16, wherein each of the pixel circuits further comprises: a detecting sub-circuit, which is connected to a detecting signal line; and the display device further comprises an external compensation circuit;

detecting signal lines connected to the detecting sub-circuit in each pixel circuit are connected to the external compensation circuit, and the detecting sub-circuit in each pixel circuit is used to output the potential of the second node in the pixel circuit to the external compensation circuit through the detecting signal lines; and the external compensation circuit is used to adjust a potential of a data signal input to the source driving circuit according to the potential of the second node.

18. The display device according to claim 17, wherein in the display panel, the detecting sub-circuits in pixel units in the same column are connected to one detecting signal line.

19. The display device according to claim 17, wherein the display device comprises: a plurality of pixels, each of the pixels comprising a plurality of adjacent pixel units;

the detecting sub-circuits in the plurality of adjacent pixel units are connected to one detecting signal line.

* * * * *